United States Patent [19]

Mattison

[11] Patent Number: 5,024,817

[45] Date of Patent: Jun. 18, 1991

[54] TWIN BED REGENERATIVE INCINERATOR SYSTEM

[75] Inventor: Glenn D. Mattison, Wellsville, N.Y.

[73] Assignee: The Air Preheater Company, Inc., Wellsville, N.Y.

[21] Appl. No.: 451,697

[22] Filed: Dec. 18, 1989

[51] Int. Cl.[5] ..... G05D 7/00

[52] U.S. Cl. ..... 422/111; 422/170; 422/175; 422/178; 431/5; 431/7

[58] Field of Search ..... 422/108, 111, 169, 170, 422/175, 178; 431/5, 7, 170

[56] References Cited

U.S. PATENT DOCUMENTS

| | | | |
|---|---|---|---|
| 3,870,474 | 3/1975 | Houston | 422/171 |
| 3,895,918 | 7/1975 | Mueller | 422/170 X |
| 4,267,152 | 5/1981 | Benedick | 422/111 |
| 4,302,426 | 11/1981 | Benedick | 422/170 X |
| 4,343,769 | 8/1982 | Henkelmann | 422/111 X |
| 4,650,414 | 3/1987 | Grenfell | 431/5 |
| 4,741,690 | 5/1988 | Heed | 431/7 |
| 4,793,974 | 12/1988 | Hebrank | 422/175 |

OTHER PUBLICATIONS

Perry, John H. Editor, "Chemical Engineering Handbook", 3rd Edition, 1950, pp. 1625 and 1626.

*Primary Examiner*—Robert J. Warden
*Assistant Examiner*—Rebekah A. Griffith
*Attorney, Agent, or Firm*—William W. Habelt

[57] ABSTRACT

A regenerative bed incinerator 10 incorporates a dwell chamber 18 disposed between a pair of spaced regenerative heat exchange the beds 14A and 14B, one of which serves as a gas preheating bed and the other of which serves as a gas cooling bed. At periodic intervals, the direction of flow through the incinerator 10 is reversed so that the functions of the beds 14A and 14B is reversed. A hot gas vent duct 80 is provided for selectively bypassing a portion 7 of the hot, incinerated process exhaust gases 5 around the gas cooling bed into the gas exhaust duct 70 for venting to the atmosphere. A bypass damper 88, which is controlled by control means 86 in responsive to exit gas temperature measurements from thermocouple 90, is positioned in the hot gas vent duct 80 to control the amount of hot, incinerated process exhaust gases bypass around the gas cooling bed.

3 Claims, 1 Drawing Sheet

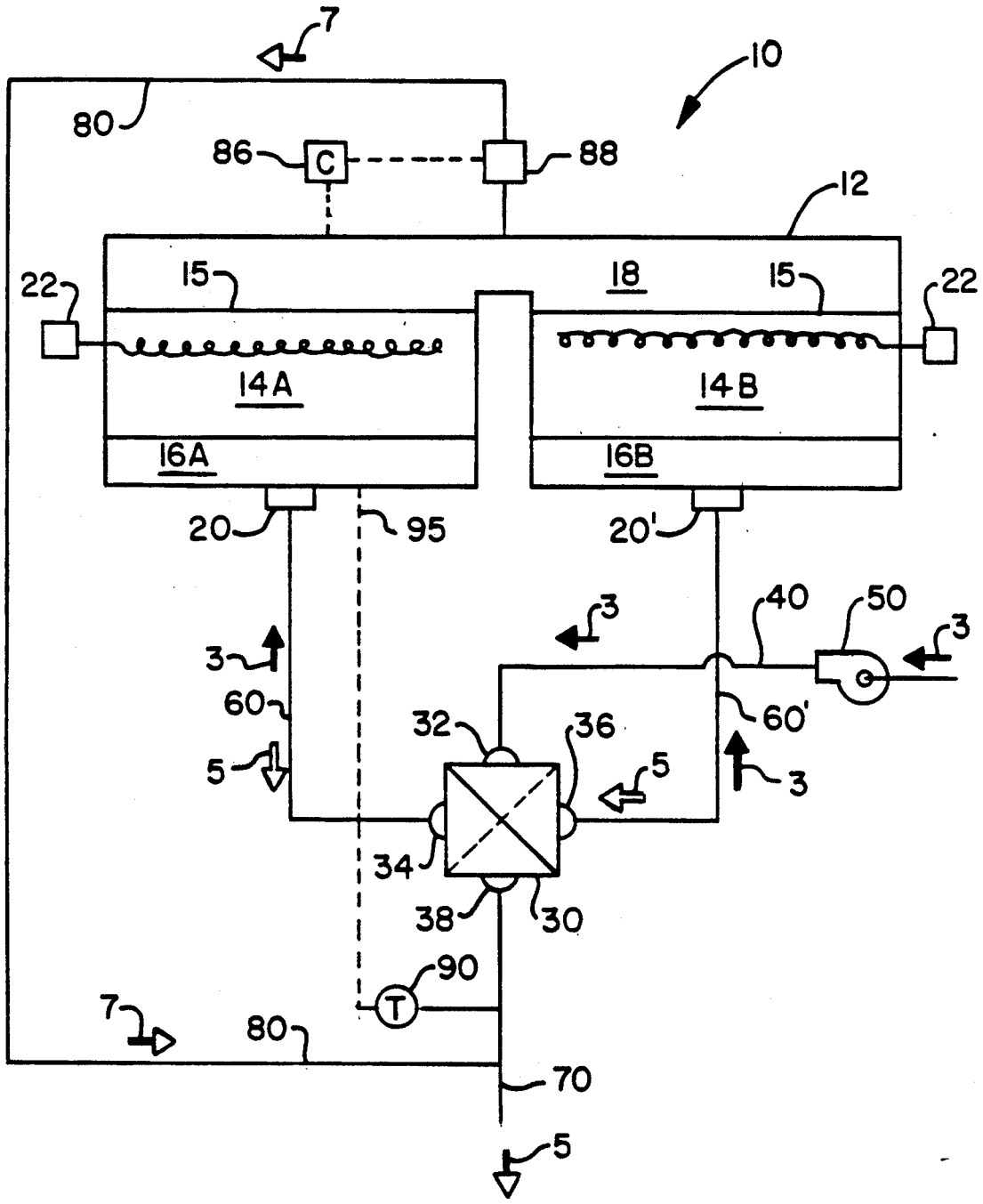
7
10
80
86
C
88
12
22
15
18
15
22
14A
14B
16A
16B
20
95
20'
3
40
50
3
3
60
60'
32
36
5
5
3
34
38
30
90
T
7
80
70
5

TWIN BED REGENERATIVE INCINERATOR SYSTEM

BACKGROUND OF THE INVENTION

The present invention relates generally to the regenerative incineration of solvents and other hydrocarbons in exhaust streams, and more particularly, to a twin bed regenerative, switching flow-type incinerator for processing waste gas/exhaust air with high hydrocarbon loadings.

Many manufacturing operations produce waste gases or exhaust air which include environmentally objectionable contaminants, generally combustible fumes such as solvents and other hydrocarbon substances, e.g., gasoline vapors, paint fumes, chlorinated hydrocarbons. The most common method of eliminating such combustible fumes prior to emitting the exhaust gases to the atmosphere is to incinerate the waste gas or exhaust air stream.

One method of incinerating the contaminants is to pass the waste gas or exhaust air stream through a fume incinerator prior to venting the waste gas or exhaust air stream into the atmosphere. An example of a suitable fume incinerator for incinerating combustible fumes in an oxygen bearing process exhaust stream is disclosed in U.S. Pat. No. 4,444,735. In such a fume incinerator, the process gas stream is passed through a flame front established by burning a fossil fuel, typically natural gas or fuel oil, in a burner assembly disposed within the incinerator. In order to ensure complete incineration of the combustible contaminants, all of the process exhaust stream must pass through the flame front and adequate residence time must be provided. Additionally, it is necessary to preheat the process exhaust stream prior to passing it through the flame front so as to increase the combustion efficiency. Of course, the cost of the heat exchanger to effectuate such preheating, in addition to the cost of the auxiliary fuel, render such fume incinerators relatively expensive.

Another type of incinerator commonly used for incinerating contaminants in process exhaust streams is the multiple-bed, fossil fuel-fired regenerative incinerator, such as, for example, the multiple-bed regenerative incinerators disclosed in U.S. Pat. Nos. 3,870,474 and 4,741,690. In the typical multiple-bed systems of this type, two or more regenerative beds of heat-accumulating and heat-transferring material are disposed about a central combustion chamber equipped with a fossil fuel-fired burner. The process exhaust stream to be incinerated is passed through a first bed, thence into the central combustion chamber for incineration in the flame produced by firing auxiliary fuel therein, and thence discharged through a second bed. As the incinerated process exhaust stream passes through the second bed, it loses heat to the material making up the bed. After a predetermined interval, the direction of gas flow through the system is reversed such that the incoming process exhaust stream enters the system through the second bed, wherein the incoming process exhaust stream is preheated prior to entering the central combustion chamber, and discharges through the first bed. By periodically reversing the direction of gas flow, the incoming process exhaust stream is preheated by absorbing heat recovered from the previously incinerated process exhaust stream, thereby reducing fuel consumption.

A somewhat more economical method of incinerating combustible contaminants, such as solvents and other hydrocarbon based substances, employing a single regenerative bed is disclosed in U.S. Pat. No. 4,741,690. In the process presented therein, the contaminated process exhaust stream is passed through a single heated bed of heat absorbent material having heat-accumulating and heat-exchanging properties, such as sand or stone, to raise the temperature of the contaminated process exhaust stream to the temperature at which combustion of the contaminants occurs, typically to a peak preheat temperature of about 9OO° C., so as to initiate oxidization of the contaminants to produce carbon-dioxide and water. Periodically, the direction of flow of the process exhaust stream through the bed is reversed. As the contaminants combust within the center of the bed, the temperature of the process exhaust stream raises. As the heated exhaust stream leaves the bed, it loses heat to the heat-accumulating material making up the bed and is cooled to a temperature about 2O° C. to 25° C. above the temperature at which it entered the other side of the bed. By reversing the direction of the flow through the bed, the incoming contaminated process exhaust stream is preheated as it passes that portion of the bed which has just previously in time been traversed by the post-combustion, hot process exhaust stream, thereby raising the temperature of the incoming process exhaust stream to the point of combustion by the time the incoming process exhaust stream reaches the central portion of the bed.

In the regenerative bed heat exchanger apparatus disclosed in U.S. Pat. No. 4,741,690, a heating means, typically an electric resistance heating coil, disposed in the central portion of the bed is provided to initially preheat the central portion of the bed to a desired temperature at which combustion of the contaminants in the process exhaust stream would be self-sustaining. Once steady state equilibrium conditions are reached, the electric resistance heating coil may usually be deactivated as the incoming process exhaust stream is adequately preheated and combustion is self-sustaining due to the gas switching procedure hereinbefore described.

SUMMARY OF THE INVENTION

The present invention provides an improved regenerative bed incinerator wherein efficient hydrocarbon destruction is ensured by providing a dwell chamber between spaced regenerative heat exchange beds, one of which serves as a gas preheating bed and the other of which serves as a gas cooling bed, the beds alternating in function as the direction of the flow of process exhaust gases through the incinerator is periodically reserved. In passing through the unfired dwell chamber from the gas preheating bed to the gas cooling bed, the process exhaust gases, which were preheated to the combustion temperature of the contaminants contained therein as the process exhaust gases passed through the preheating bed and at least partially incinerated therein, are maintained at combustion temperature for a sufficient amount of time to ensure the incineration is substantially complete before the process exhaust gases are cooled as the gases pass from the dwell chamber through the gas cooling bed and are thence vented to the atmosphere as an environmentally clean process exhaust gas.

BRIEF DESCRIPTION OF THE DRAWING

The present invention will be better understood as described in greater detail hereinafter with reference to the drawing wherein the sole figure illustrates schematically a twin bed regenerative incinerator designed in accordance with the present invention with a dwell chamber disposed between a pair of spaced regenerative heat exchange beds.

DESCRIPTION OF A PREFERRED EMBODIMENT

Referring now to the drawing, there is depicted in the sole figure thereof a regenerative bed incinerator 1O advantageously suited for the incineration of contaminants in a process exhaust gas stream. It is to be understood that the term process exhaust gases as used herein refers to any process off-stream, be it waste gas or exhaust air, which is contaminated with combustible fumes of an environmentally objectionable nature including, without limitation, solvents, gasoline vapors, paint fumes, chlorinated hydrocarbons and other hydrocarbon substances, and which bears sufficient oxygen, in and of itself or through the addition of air thereto, to support combustion of the contaminants.

The regenerative bed incinerator 10 comprises a housing 12 enclosing a pair of spaced heat exchange beds 14A and 14B, each comprised of heat-accumulating and heat-transfer material and an unfired dwell chamber 18 extending therebetween and defining a gas flowpath between the spaced beds. A lower gas plenum is disposed subadjacent each of the beds 14A and 14B. Each of the lower gas plenums 16A and 16B is provided with a gas flow aperture opening 20, which alternately serves as a gas flow inlet or outlet depending upon the direction of gas flow through the bed, which as will be discussed further hereinafter is periodically reversed.

Each bed 14A,14B is comprised of particulate, heat-accumulating and heat-transfer material, such as sand or stone or other commercially available ceramic or metallic material which has the ability to absorb, store and exchange heat, and which is sufficiently heat resistant so as to withstand without deterioration the gas temperatures experienced during combustion of the contaminants within the bed. The particulate bed material is loosely packed within the beds 14A,14B to provide sufficient void space within the bed volume such that the process exhaust gases may freely flow therethrough in either direction via a multiplicity of random and tortuous flow paths so that sufficient gas/material contact is provided to ensure good heat transfer. The particular size of the bed material and gas flow velocity (i.e., pressure drop) through the bed is somewhat application dependent and will vary from case to case. Generally, the bed material will be greater than about two millimeters in its minimum dimension. The gas flow velocity through the beds 14A,14B is to be maintained low enough to preclude fluidization of the particulate bed material.

Preferably, heating means 22, such as an electric resistance heating coil, is embedded within each of the beds 14A,14B in the upper region thereof, advantageously buried subadjacent the surface 15 of each bed 14A,14B. The heating means 22 may be selectively energized to preheat the material in the upper region of each bed 14A,14B to a temperature sufficient to initiate and sustain combustion of the contaminants in the process exhaust gases, typically to a temperature of about 9OO° C. Once steady-state, self-sustaining combustion of the contaminants is attained, the heating means 22 is typically deactivated. Although not generally necessary, the heating means 22 may be periodically reactivated, or even continuously activated at a low level, to provide supplemental heat to the upper region of the beds 14A,14B to ensure self-sustaining combustion of the contaminants as the contaminants pass therethrough into the dwell chamber 18.

Both of the lower gas plenums 16A and 16B are connected in flow communication to valve means 30 which is adapted to receive through the supply duct 40 from the fan 50 incoming process exhaust gases 3 to be incinerated at the first port 32 thereof and selectively direct the received process exhaust gases 3 through either the gas duct 60 which connects the opening 20 of the lower gas plenum 16A of the first bed 14A in flow communication to the second port 34 of the valve means 30 or the gas duct 60' which connects the opening 20' of the lower gas plenum 16B of the second bed 14B in flow communication to the third port 36 of the valve means 30. The fourth port 38 of the valve means 30 is connected to the exhaust duct 70 through which the incinerated process gas stream 5 is vented to the atmosphere.

At spaced intervals, typically every few minutes, valve means 30 is actuated to reverse the flow of gases through the incinerator 10. Thus, every few minutes the role of the lower gas plenums 16A and 16B are reversed with one going from serving as an inlet plenum to serving as an outlet plenum for the incinerator 10, while the other goes from serving as an outlet plenum to serving as an inlet plenum for the incinerator 10. A few minutes later, their role is again reversed. In this manner the beds alternate in function from gas cooling to gas preheating as the direction of the flow of process exhaust gases through the incinerator 10 is periodically reversed. That is, the regenerative heat exchange the beds 14A and 14B alternately absorb heat from the incinerated process exhaust gases leaving the dwell chamber 18 between the beds 14A and 14B wherein combustion of the contaminants in the process exhaust is completed, and thence give up that recovered heat to incoming process exhaust gases being passed into the incinerator 10 for incineration.

With the valve means 30 in position A, the incoming process exhaust gases 3 to be incinerated are directed through the first port 32 of the valve means 30 to the second port 34 thereof, thence through gas duct 60 to the lower gas plenum 16A of the bed 14A to pass upwardly therefrom through the bed 14A wherein the process exhaust gases are preheated, thence through the central dwell chamber 18 between the beds 14A and 14B wherein the contaminants are retained at a temperature high enough to ensure complete incineration, thence downwardly through the bed 14B wherein the incinerated process exhaust gases are cooled by transferring heat to the bed material in the bed 14B, and thence into the lower gas plenum 16B of the bed 14B. The incinerated process exhaust gases 5 are thence passed therefrom through the gas duct 60', to the third port 36 of the valve means 30 and is thence directed through the fourth port 38 of the valve means 30 to the exhaust duct 70 for venting to the atmosphere.

With the valve means 30 in position B, the incoming process exhaust gases 3 to be incinerated are directed through the first port 32 of the valve means 30 to the third port 36 thereof, thence through gas duct 60' to the lower gas plenum 16B of the bed 14B to pass upwardly therefrom through the bed 14B wherein the process exhaust gases are preheated, thence through the central dwell chamber 18 between the beds 14A and 14B wherein the contaminants are retained at a temperature high enough to ensure complete incineration, thence downwardly through the bed 14A wherein the incinerated process exhaust gases are cooled by transferring heat to the bed material in the bed 14A, and thence passes into the lower gas plenum 16A of the bed 14A. The incinerated process exhaust gases 5 are thence passed therefrom through the gas duct 60 to the second port 34 of the valve means 30 and is thence directed through the fourth port 38 of the valve means 30 to the exhaust duct 70 for venting to the atmosphere.

In the twin bed incinerator apparatus of the present invention, combustion generally takes place in the upper half portion of the preheat bed and the process gas immediately starts losing heat to the bed material. However, once the hot incinerated process gases pass through the surface 15 of the preheat bed into the unfired, uncooled dwell chamber 18, the hot process gas remain essentially at a constant temperature as they traverse the dwell chamber 18. Being uncooled and unfired, the dwell chamber 18 provides a flow passage between the heat exchange beds 14A and 14B through which the hot process gases pass while maintaining a substantially constant temperature for a period of time so as to ensure substantially total destruction of the particular contaminants therein before the hot process gases enter the process gas cooling bed. Upon entering the gas cooling bed, the process gases cool rapidly and are typically cooled after having traversed the remaining portion of the bed to a temperature that is typically only 2O° C. to 25° C. higher than the temperature at which the process gases initially entered the bed.

As noted previously, combustion of the contaminants within the process exhaust gases passed to the incinerator 10 is initiated within the bed 14 that the process exhaust gases enter, i.e., the gas preheating bed, and is substantially completed prior to entering the other bed 14, i.e., the gas cooling bed. For low hydrocarbon loadings, combustion of the contaminants will normally be completed within the bed 14 before the process exhaust gases entered the dwell chamber 18. For moderate and high hydrocarbon loadings, combustion of the contaminants will to some extent carry over into the dwell chamber 18, but most of the combustion of the contaminants will still occur within the gas preheating bed. Also, the point within the gas preheating bed at which oxidization of the hydrocarbon contaminants begins not only depends upon the nature of the hydrocarbon contaminant, its chemical stability and its ignition temperature, but also on the hydrocarbon loading in the process exhaust stream.

At high hydrocarbon loadings, the point at which oxidization, i.e., combustion, of the hydrocarbon contaminants is initiated within the gas preheating bed is delayed, that is positioned closer to the surface 15 of the bed, and the extent over which the combustion occurs is widened. As a result, the gas temperature within the dwell chamber 18, and thus the temperature of the gases entering the gas cooling bed from the dwell chamber 18, increases. After repeated cycling of the incinerator 10 at high hydrocarbon loadings, excessive gas temperatures within the dwell chamber 18 and in the process exhaust gas stream 5 leaving the gas cooling bed will be reached. Excessive gas temperatures are to be avoided so that common, less expensive materials may be used in construction of the incinerator housings and other components such as the gas switching valve means 30.

Accordingly, for applications in which high hydrocarbon loadings are expected, a hot gas vent duct 80 is provided for selectively bypassing a portion of the incinerated process exhaust gases from the dwell chamber 18 around the gas cooling bed and into the exhaust duct 70 for venting to the atmosphere. By bypassing a portion of the high temperature process exhaust gases about the gas cooling bed, the amount of heat absorbed by the gas cooling bed may be controlled so that excessive preheating of the incoming high hydrocarbon contaminated process exhaust gases is avoided thereby limiting the gas temperatures achieved during oxidization within the incinerator 10.

To regulate the amount of bypass flow 7 through the gas vent duct 80, a temperature sensing means 90, such as a thermocouple, is disposed in the exhaust gas duct 70 at a location downstream of the gas switching valve means 30 and upstream of the location of the entrance of the gas vent duct 80 into the exhaust duct 70 for measuring the temperature of the incinerated process exhaust gas 5 passing through the exhaust duct 70. The temperature sensing means 90 generates a temperature signal 95 which is essentially indicative of the temperature of the incinerated process exhaust gas flow leaving the regenerative bed oxidizer 10 and transmits the temperature signal 95 to a gas bypass controller 86 which operates bypass damper 88 which functions to selectively open or close thereby regulating the amount of hot incinerated process exhaust gas 7 passing through the gas vent duct 80.

The gas bypass controller 86 compares the measured temperature indicated by the signal 35 with a preselected set point temperature which represents the maximum gas temperature to be permitted. If the measured temperature exceeds an upper set point temperature, the gas bypass control means 86 opens the gas bypass damper 88 to increase the flow of hot process exhaust gases through the gas bypass duct 80. Conversely, if the measured temperature drops below a lower set point temperature, the gas bypass control means 86 closes the gas bypass damper 88 to decrease or stop the flow of hot process exhaust gases through the bypass duct 80 thereby causing the flow of hot process exhaust gases through the gas cooling bed to increase and return to their normal flow.

I claim:

1. A regenerative bed incinerator system for treating combustible contaminants in a process gas stream, comprising:

a. incinerator means for receiving the contaminated process gas stream, preheating the contaminated process gas stream, incinerating the combustible contaminants in the preheated process gas stream, cooling the incinerated process gas stream, and discharging the cooled incinerated process gas stream, said incinerator means having a first gas permeable bed disposed in spaced relationship with a second gas permeable bed, and an unfired and uncooled dwell chamber disposed therebetween, each of said first and second gas permeable beds being formed of a particulate material having heat-accumulating and heat-exchanging properties; and b. gas flow directing means operatively associated with said incinerator means for receiving the contaminated process gas stream, alternately directing the contaminated process gas stream to and through said incinerator means in opposite, alternate directions so as to periodically reverse the direction of gas flow through said incinerator means, and for receiving a cooled incinerated process gas stream from said incinerator means and discharging said cooled incinerated process gas stream, whereby said first and second gas permeable beds alternate in function with the one of said gas permeable beds which is upstream with respect to gas flow being a contaminated process gas preheating bed and the one of said gas permeable beds which is downstream with respect to gas flow being an incinerated process gas cooling bed.

2. A regenerative bed incinerator system as recited in claim 1 further comprising:

a. a process gas stream vent duct connected in flow communication with said gas flow directing means for exhausting said cooled incinerated process gas stream discharging from said gas flow directing means;

b. a hot gas bypass duct having an inlet opening to said dwell chamber and at outlet opening to said process gas stream vent duct thereby providing for venting a portion of the hot incinerated process gases passing through said dwell chamber directly into the hot gas bypass duct; and c. control means operatively associated with said hot gas bypass duct for selectively controlling the flow of hot incinerated process gases passing through said hot gas bypass duct.

3. A regenerative bed incinerator system as recited in claim 2 wherein said control means comprises:

a. temperature sensing means disposed in said process gas stream vent duct at a location upstream of the inlet of said hot gas bypass duct thereto for measuring the temperature of the cooled incinerated process gases passing therethrough and generating a temperature signal indicative of said temperature;

b. gas flow regulation means disposed in said hot gas bypass duct for selectively opening and closing the hot gas bypass duct whereby the flow of hot incinerated process gases passing therethrough may be controlled; and c. controller means operatively associated with said gas flow regulation means for receiving said temperature signal, comparing said temperature signal to a preselected set point value indicative of the desired maximum temperature for the cooled incinerated process gases through said gas vent duct, and generating a control signal in response to said comparison and transmitting said control signal to said gas flow regulation means so as to maintain the measured gas temperature below said preselected set point temperature by controlling the flow of hot incinerated process gases bypassing the gas cooling bed through said hot gas vent duct.

* * * * *